United States Patent [19]

Hosler, Sr.

[11] Patent Number: 5,062,808

[45] Date of Patent: Nov. 5, 1991

[54] ADAPTER FOR INTERCONNECTING SOCKET CONNECTORS FOR TRIAXIAL CABLE

[75] Inventor: Robert C. Hosler, Sr., Marysville, Pa.

[73] Assignee: AMP Incorporated, Harrisburg, Pa.

[21] Appl. No.: 684,719

[22] Filed: Apr. 12, 1991

[51] Int. Cl.[5] ..... H01R 17/18

[52] U.S. Cl. ..... 439/580; 439/675; 439/654

[58] Field of Search ..... 439/578-585, 439/675, 638-640, 651-655, 322, 628

[56] References Cited

U.S. PATENT DOCUMENTS

| | | | |
|---|---|---|---|
| 4,593,464 | 6/1986 | Williams et al. | 439/675 |
| 4,728,301 | 3/1988 | Hemmer et al. | 439/585 |
| 4,781,622 | 11/1988 | Ratchford et al. | 439/585 |
| 4,846,731 | 7/1989 | Alwine | 439/651 |
| 4,857,014 | 8/1989 | Alf et al. | 439/628 |
| 4,997,391 | 3/1991 | Federico et al. | 439/580 |

OTHER PUBLICATIONS

AMP Instruction Sheet IS 9324, Apr. 10, 1987, AMP Incorporated.

AMP Catalog 73-162, Feb. 1990, AMP Incorporated.

Military Specification Sheet MIL-C-39029/95, Aug. 8, 1985, U.S. Dept. of Defense.

McDonnell Douglas Standard Part Doc. no. ST5M1502, McDonnell Douglas.

Military Specification Sheet MIL-C-39029/96, Aug. 8, 1985, U.S. Dept. of Defense.

McDonnell Douglas Standard Part Doc. No. ST5M1503, McDonnell Douglas.

*Primary Examiner*—David L. Pirlot

*Attorney, Agent, or Firm*—Anton P. Ness

[57] ABSTRACT

A triaxial adapter assembly (10) including an inner contact (50), a pair of first dielectric sleeves (70,90), an intermediate contact (110), a pair of second dielectric sleeves (130,160) and a pair of telescoping outer contact shell member (20,30) securing the adapter assembly (10) together, for interconnecting two triaxial connectors (200,300). The inner contact (50) includes an annular collar (54) to define precisely located stop means for placement of the first sleeves (70,90) thereover, which in turn have precisely located stop surfaces to abut precisely located stop means within the intermediate contact (110). The intermediate contact (110) includes an annular collar (118) to define precisely located stop means for placement of second sleeves (130,160) thereover, which in turn have precisely located stop surfaces to abut precisely located stop means within the outer contact shells (20,30). The components are precisely dimensioned and shaped, and the axially abutting surfaces at of all the components coordinated, to assure that the contact ends of the inner contact (50) are precisely known with respect to the ends of the intermediate and outer contacts (110,20,30) and to assure that the inner contact (50) is secured against axial movement at all times after assembly of adapter (10).

12 Claims, 7 Drawing Sheets

ADAPTER FOR INTERCONNECTING SOCKET CONNECTORS FOR TRIAXIAL CABLE

FIELD OF THE INVENTION

The present invention is related to the field of electrical connectors and more particularly to connectors for triaxial cable.

BACKGROUND OF THE INVENTION

Electrical cable having an inner conductor, an intermediate primary shield braid and a secondary or outer shield braid has been in commercial use and known as triaxial cable; the inner conductor is surrounded by a dielectric insulation of controlled thickness so that the intermediate shield braid is coaxial therearound, and another dielectric insulation layer surrounds the intermediate shield and in turn is surrounded by the outer shield braid around which is an outer jacket. The primary or intermediate shield is utilized as a ground for the particular article to which the inner conductor is electrically connected; the secondary or outer shield serves as chassis ground and is connected to the outer conductive housing of the apparatus in which the article is mounted such as a computer or an aircraft fuselage. Triaxial cable is commonly utilized to conduct radiofrequency signals at 20 megaHertz with a nominal impedance of 75 ohms, such as for transmission of video signals.

Electrical connectors are known which are used to terminate triaxial cables, and comprise an inner contact, an intermediate ground coaxially around the inner contact and insulated therefrom, and an outer conductor coaxially around the intermediate ground. An example of such a connector is sold by AMP Incorporated, Harrisburg, Pa. under Part No. 222191-1. For many applications at least the mating interface of such connectors is controlled by Specifications such as Military Specification MIL-C-39029/95 and /96 (for "Size 8") and MIL-C-81659 Series 2 (for "Size 5").

Many such connectors have been installed in apparatus over the years and remain useful. It has become desirable to provide for protection of the signals along the circuits in which the connectors have been installed, against electromagnetic pulse (EMP) or electrostatic discharge (ESD), while retaining the already installed connectors in service in a retrofit program. One particular problem has been to provide a package of discrete signal line filters of severely limited dimensions at the mating interface of such in-service connectors with circuit boards or with mating connectors, such as in black boxes in electronics bays of aircraft where almost all space has already been utilized by necessary components. Therefore, any dimension of any element added between the electrical connectors at input/output ports of black boxes to circuit boards therewithin must be kept minimal, for example. Any such filter package retrofitted into black boxes of conventional design must also be removable and replaceable, and compatible with connectors of wiring harnesses already installed in apparatus such as aircraft.

It is desired to provide an interconnecting element for a triaxial connector to a corresponding triaxial connector which maintains the signal integrity and has as short an axial dimension as possible. It is desired to provide such an interconnecting element which is matable with and unmatable from the triaxial connectors after installation for the mating interface of an overall assembly containing one of the triaxial connectors to be separable from the assembly containing the adapter and the other triaxial connector.

SUMMARY OF THE INVENTION

The present invention is an adapter having contact sections on each end for an inner conductor, an intermediate conductor and an outer conductor, which are matable with triaxial connectors. A centrally disposed precision inner contact includes pin contact sections at each end, matable with socket contacts of matable plug connectors at both mating faces of the adapter. A first precision dielectric sleeve assembly surrounds the inner contact which is disposed within a precision intermediate contact. A second precision dielectric sleeve assembly surrounds the intermediate contact, and the adapter is completed by outer shell members surrounding the second dielectric sleeve assembly. The intermediate contact at least at one end includes outwardly deflectable spring arms enshrouding the pin contact section, to be engaged by a conductive barrel of a mating triaxial plug connector, enabling the length of the mating triaxial plug connector to be shortened from an otherwise conventional design, thus enabling the shortening of the axial length of the interconnection.

The adapter assembly of the present invention is fabricated of precision components which are assembled in such a way that the inner contact is incapable of movement during mating and unmating with the corresponding triaxial connectors which it interconnects, and to assure that the inner contact is precisely positioned or referenced both axially and radially with respect to the intermediate and outer contacts. The first sleeves are positioned about the inner contact and firmly against an annular collar thereof, with an annular flange of one of the sleeves overlapping an adjacent end of the other to define an elongate indirect path to minimize voltage leakage thereat; in the event of voltage surges during in-service use, such structure would protect other electrical and electronic components elsewhere in the system, such as those mounted on a circuit board, which happen to be commoned with the intermediate contact or with the outer conductor. The inner contact with first sleeves therearound is mounted within the intermediate contact such as by using a press fit ring in a manner which forces the first sleeve assembly firmly against an inner ledge of the intermediate contact, thus locating the inner contact precisely axially with respect to the intermediate contact, defining a subassembly.

The subassembly is mounted within forward and rearward outer contact sleeves so that an annular collar of the intermediate contact is firmly trapped between inner ledges of both dielectric second sleeves within the respective shell members. A solid interference fit is defined between an annular flange of one of the outer shell members over an adjacent end of the other outer shell member, holding the entire assembly together. With the second dielectric sleeves held firmly between inner ledges of the two outer shell members, and the subassembly held firmly between inner ledges of the second dielectric sleeves, the precise axial reference is maintained between the inner contact and the outer shell members. All components are precisely dimensioned to assure that radially adjacent surfaces of the components selectively either are close or in interference fit, and that axially adjacent surfaces selectively either are close or firmly abut.

It is an objective of the present invention to provide an adapter which is matable with and unmatable from opposing triaxial connectors which it interconnects and removable from therebetween.

It is a further objective to provide such an adapter with an assuredly immobile inner contact precisely located axially and radially within an intermediate and an outer contact, to maintain strictly controlled mating interface requirements for triaxial connections.

It is an additional objective to provide such an adapter with minimized axial length between the opposed triaxial connectors which it interconnects.

An embodiment of the present invention will now be described by way of example with reference to the accompanying drawings.

DESCRIPTION OF THE PREFERRED EMBODIMENT

Figure 1:
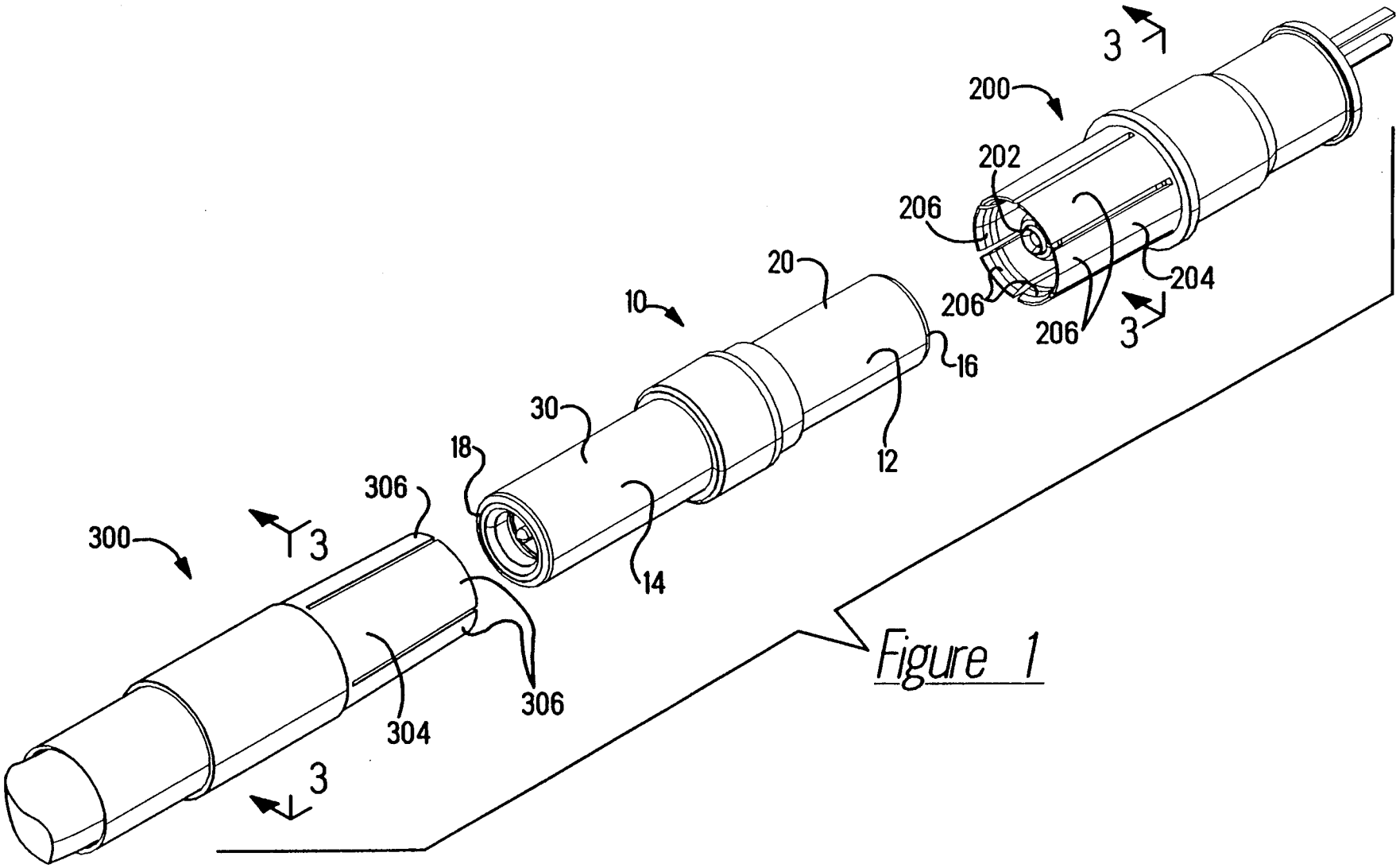
FIG. 1 is an isometric view illustrating the adapter of the present invention positioned between opposed triaxial connectors to define an interconnection.

In FIG. 1 an adapter 10 of the present invention is poised to axially mate with and electrically interconnect first triaxial connector 200 and second triaxial connector 300. Second triaxial connector 300 is shown to be of the type generally referred to as a "Size 5" connector as set forth in MIL-C-81659 Series 2 and is mounted on cable, while first triaxial connector 200 is shown to be similar to a "Size 8" connector as set forth in MIL-C-39029/95 and is shown to be mountable to a circuit element such as a circuit board; both contain socket type inner contacts matable with pin type inner contacts. Many "Size 5" triaxial connectors have been installed and are in in-service use, such as in black boxes in aircraft and the like, contained within hybrid connector assemblies such as ARINC connectors of the type sold by AMP Incorporated under the designation ARINC 404, Part No. 213438-8, and having a Descriptive Part No. RM-2-R-67P-32C2P-0001 (200) with the actual triaxial connector such as is sold by ITT Cannon under the designation 152100-1800. The socket contacts of connectors 200,300 are ensiled within dielectric towers for physical protection and for insulation, with the intermediate contacts comprising conductive walls along the outside surfaces of the towers, defining plug portions such as portion 202 the leading end of which is seen in FIG. 1, which in turn are surrounded by forward sections of outer contacts 204,304 respectively.

Adapter 10 is seen to have axially opposed mating portions 12,14 adapted to mate with triaxial connectors 200,300 respectively. Mating portions 12,14 surround and enshroud respective pin contact sections, with the leading ends of the pin contact sections recessed from leading ends 16,18 of mating portions 12,14. Outer contact shell members 20,30 are disposed along the outside of adapter 10 and joined together, and define circumferentially continuous outer contacts about both mating portions 12,14. Outer contacts 204,304 of triaxial connectors 200,300 define pluralities of spring arms 206,306 which are deflected outwardly during mating with adapter 10 establishing an assured ground connection with outer contact shell members 20,30 for a continuous ground interconnection.

Figure 2:
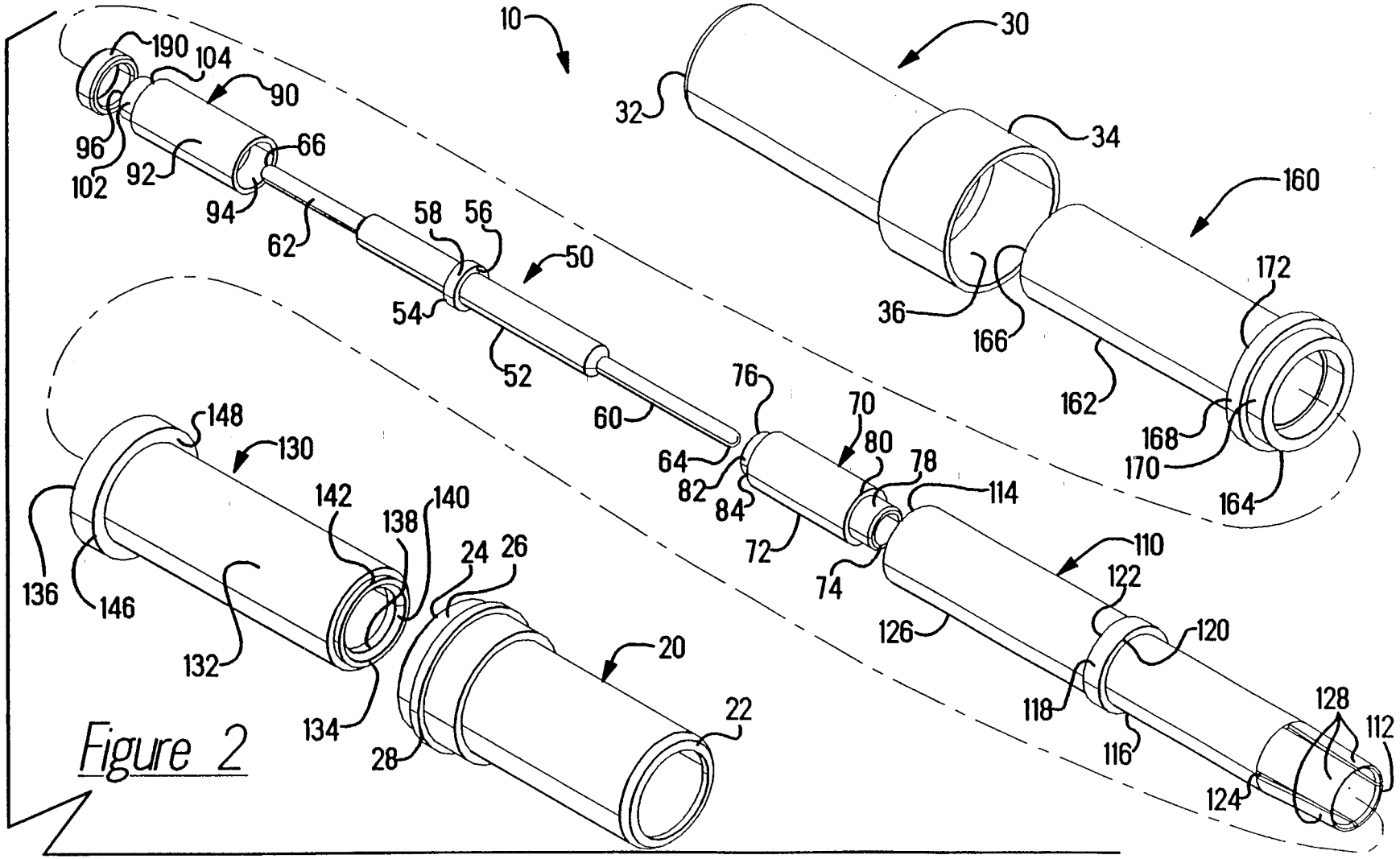
FIG. 2 is an isometric exploded view of the components of the adapter.

Referring now to FIG. 2, adapter 10 includes an inner contact member 50, an intermediate contact member 110 and forward and rearward outer contact shell members 20 and 30. Forward and rearward first or inner dielectric sleeve members 70,90 are disposed between inner contact 50 and intermediate contact 110. Forward and rearward second or outer dielectric sleeve members 130,150 surround intermediate contact 110 and are surrounded by forward and rearward outer contacts 20 and 30 respectively. Press ring 190 is seen which will be inserted and press fit into rearward end 114 of intermediate contact 110 after forward first sleeve 70, inner contact 50 and rearward first sleeve 90 have been inserted into rearward intermediate contact end 114, which secures inner contact 50 and sleeves 70,90 firmly within intermediate contact 110 defining a subassembly 192 best seen in FIG. 5.

Figure 3:
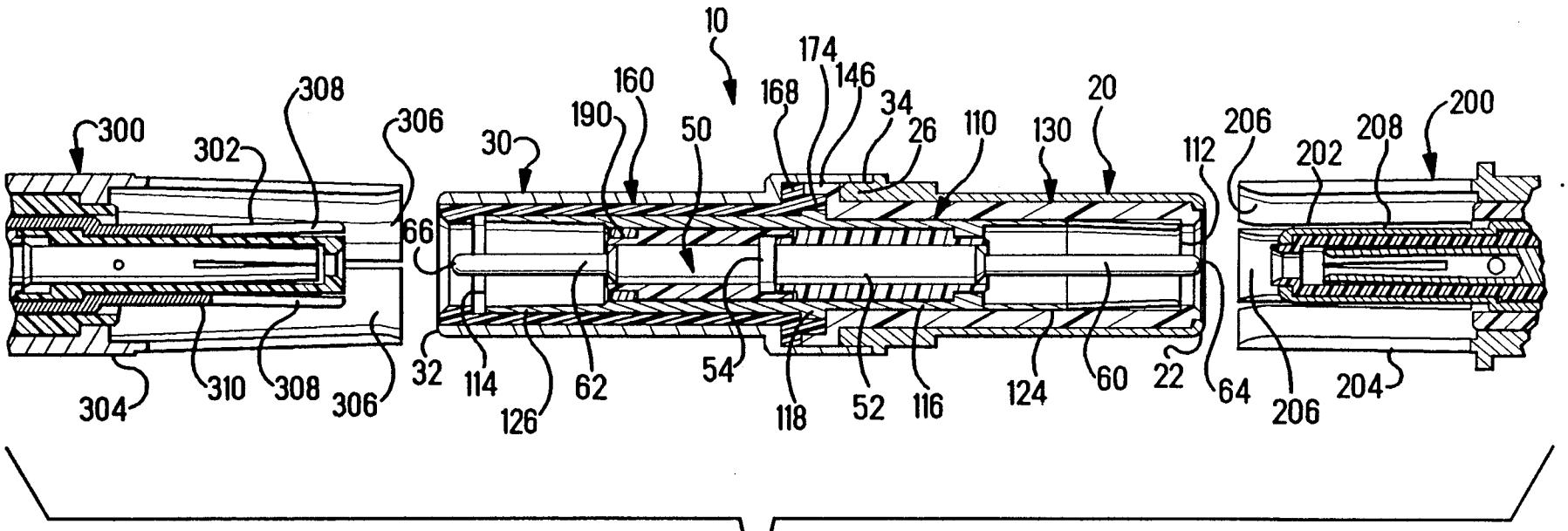
FIG. 3 is an enlarged longitudinal section view of the exploded interconnection taken along lines 3—3 of FIG. 1.
Figure 4:
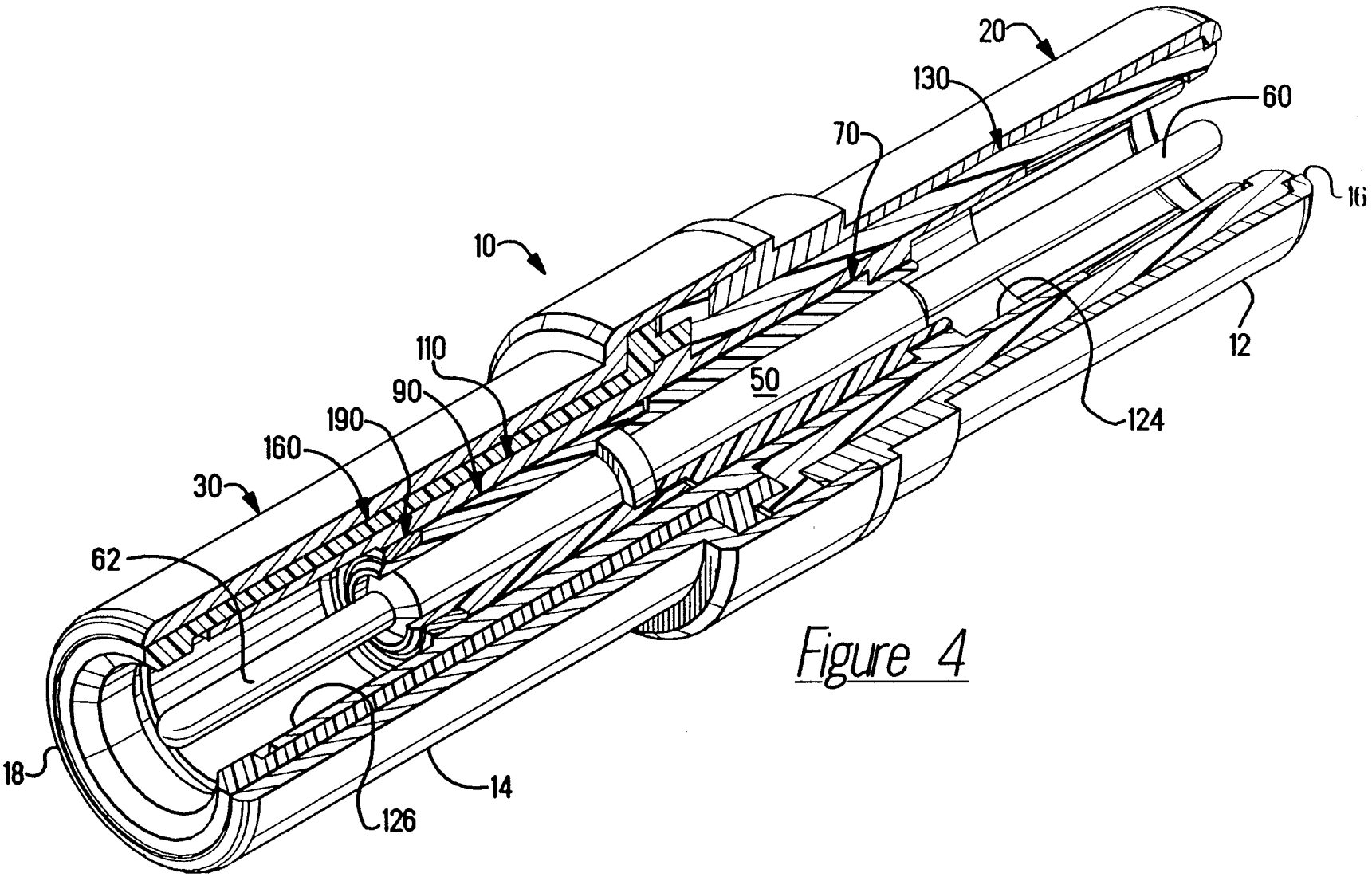
FIG. 4 is a part section isometric view similar to FIG. 3 better illustrating the relationship between the components of the adapter.
Figure 5:
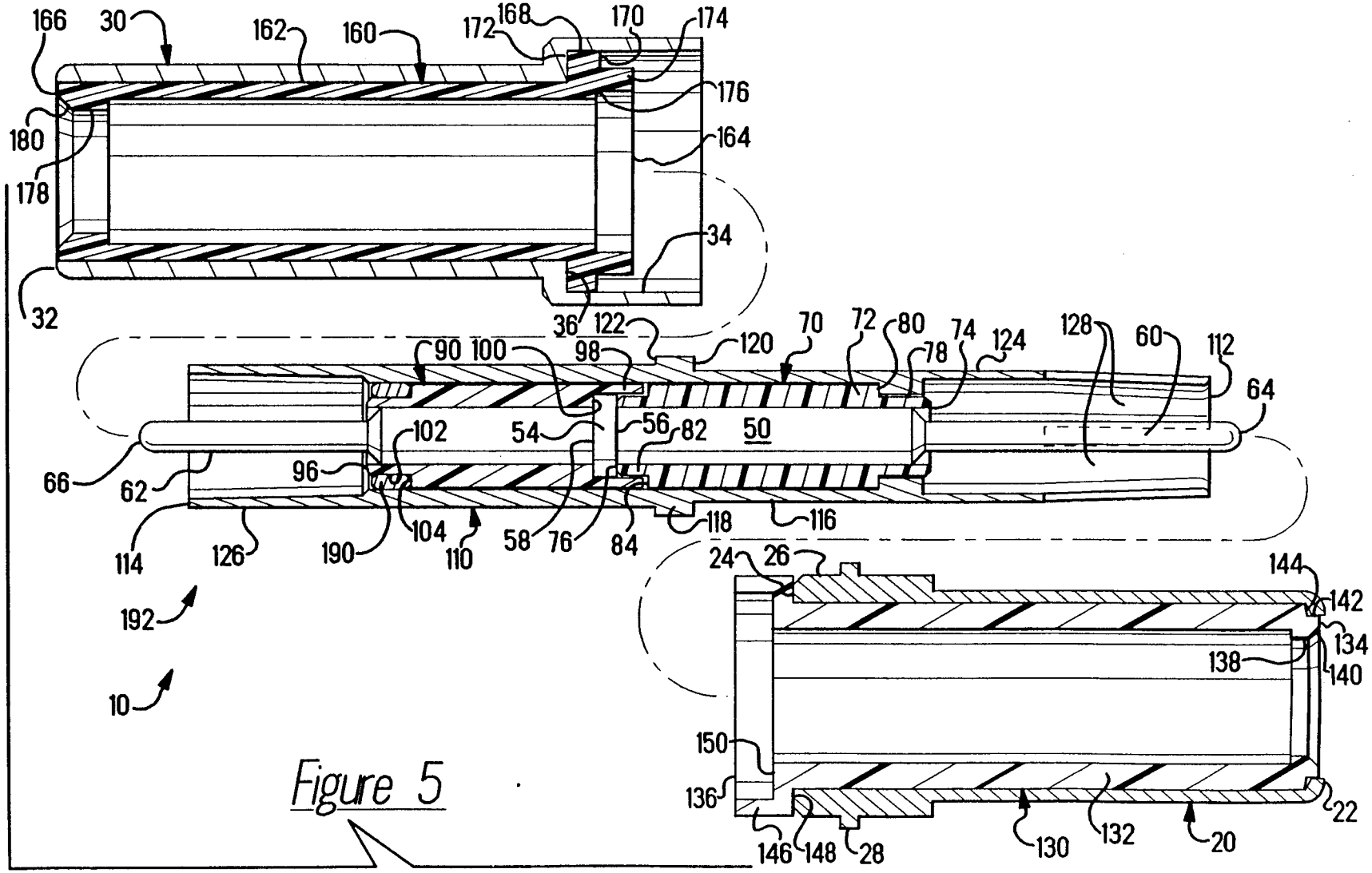
FIG. 5 is a longitudinal section view of the components of the adapter of FIG. 2 partially assembled.

In FIGS. 3 to 5 inner contact 50 is secured within dielectric first sleeves 70,90 within intermediate contact 110 and coaxially held therewithin, which in turn is secured within dielectric second sleeves 130,160 within outer contacts 20,30 and coaxially held therewithin. Inner contact 50 includes a body section 52 having an annular collar 54 relatively centrally disposed therealong which defines forwardly and rearwardly facing stop surfaces 56,58, and further includes forward and rearward pin contact sections 60,62 having respective leading pin ends 64,66 spaced controlled distances just past forward and rearward leading ends 112,114 of intermediate contact 110 and just recessed within forward and rearward leading ends 22,32 of forward and rearward outer contacts 20,30 respectively. Intermediate contact 110 includes a body section 116 having an annular collar 118 relatively centrally disposed therealong defining forwardly and rearwardly facing stop surfaces 120,122, and further includes forward and rearward contact sections 124,126 extending to leading ends 112,114 respectively; forward contact section 124 includes an array of short cantilever beam spring arms 128 slightly converging at leading end 112 and deflectable outwardly against the inside surface of forward second sleeve 130 therearound upon mating of adapter 10 with triaxial connector 200, when engaging the outer surface of intermediate contact 208 of plug portion 202.

Forward first sleeve 70 includes body section 72 extending to a forward end 74 and a rearward end 76, and includes a reduced diameter portion 78 at forward end 74 defining a forwardly facing stop surface 80, and a reduced diameter portion 82 at rearward end 76 defining a rearwardly facing surface 84. Rearward first sleeve 90 includes body section 92 extending to a forward end 94 and a rearward end 96, and includes an enlarged diameter flange section 98 at forward end 94 defining forwardly facing stop surface 100 and a reduced diameter portion 102 at rearward end 96 defining a rearwardly facing stop surface 104.

Forward second sleeve 130 includes body section 132 extending to forward end 134 and rearward end 136, and includes a short reduced diameter collar 138 at forward end 134 defining a protective entrance for spring arms 128 of intermediate contact 110 when receiving thereinto plug portion 202 of connector 200 upon mating and is also beveled at peripheral inner edge 140 to provide a lead-in, and includes a step at peripheral outer edge 142 to define a stop surface 144; forward second sleeve 130 also includes short enlarged diameter flange section 146 at rearward end 136 which defines both a forwardly facing stop surface 148 and a rearwardly facing stop surface 150. Rearward second sleeve 160 includes body section 162 extending to forward end 164 and rearward end 166, and includes an annular collar 168 defining a forwardly facing stop surface 170 and a rearwardly facing stop surface 172, forwardly from which extends a flange section 174 extending to forward end 164 and including an enlarged inner diameter defining a forwardly facing stop surface 176; rearward second sleeve 160 further includes a short reduced diameter collar 178 at rearward end 166 defining a protective entrance for receipt of plug portion 302 of triaxial connector 300 and which is beveled at peripheral inner edge 180 to provide a lead-in for plug portion 302 and which assists in engaging and deflecting inwardly the array of slightly diverging spring arms 308 of intermediate contact 310 of connector 300.

Forward outer shell contact 20 includes a rearward end 24 the outer surface 26 of which is preferably knurled, and having an annular collar 28 near rearward end 24. Rearward outer shell contact 30 includes an enlarged diameter forward end 34 defining a forwardly facing stop surface 36.

Inner contact 50 may be machined of brass; intermediate contact 110 may be machined of beryllium copper which is heat treated to enhance spring properties of spring arms 128; and outer contact shells 20,30 may be machined of brass with the outwardly facing surface 26 of rearward end 24 of forward shell 20 preferably knurled. Press ring 190 may be made of brass which is knurled along the outwardly facing surface. First and second dielectric sleeves 70,90,130,160 may be molded of polypropylene or polytetrafluoroethylene and subsequently machined for precision dimensioning and shape; polypropylene may also be useful in moderate temperature environments.

In a first assembly step forward first sleeve 70 is placed over the forward end of inner contact 50, and rearward first sleeve 90 is placed over the rearward end of inner contact 50 such that a stop surface of an inside ledge of the rearward first sleeve 90 abuts a shoulder of a centrally located collar of the inner contact 50 and an annular flange extends axially past the collar and overlaps a rearward end of the forward first sleeve 70. In practice these components are assembled within the intermediate contact 110 by insertion into rearward end 114 thereof until a stop surface of the forward end of the forward first sleeve 70 abuts an inside ledge of the intermediate contact 110, after which press ring 190 is inserted over the rearward end of the rearward first sleeve 90 and tightly pressed axially into a strong interference fit into the axial groove defined between the inner surface of intermediate contact 110 and the outer surface of reduced diameter portion 102 of rearward first sleeve 90 and against stop surface 104. Forced insertion of press ring 190 against stop surface 104 forces the rearward sleeve 90 against the inner contact collar, and the inner contact collar is forced against the rearward end of the forward sleeve 70 which in turn has a stop surface near its forward end which is forced against the ledge of the intermediate contact 110.

Thus a subassembly 192 is defined in which the ensleeved inner contact 50 is firmly secured within the intermediate contact 110 abutting an inner ledge thereof at a location precisely referenced axially with respect to the front and rear ends of the intermediate contact, and precisely referenced radially with respect to the inside diameter of the intermediate contact. The overlapping flanges of the dielectric first sleeves 80,90 defines an elongate indirect path minimizing voltage leakage.

In a second assembly step subassembly 192 is inserted into forward outer contact shell member 20, which has dielectric forward second sleeve 130 at least disposed therewithin, until an annular collar of intermediate contact 110 abuts an inner ledge of the forward second sleeve 130 which in turn abuts an inturned lip at the front end of forward outer contact shell 20. Completing the assembly of adapter 10, rearward outer contact shell 30 with dielectric rearward second sleeve 160 at least disposed therein, is inserted over the rearward end of subassembly 192. Forwardly extending annular flange 34 of rearward outer contact shell 30 is tightly force fit axially over rearward portion 26 of forward outer contact shell 20 until brought into abutment with the stop surface defined by annular collar 28.

Regarding second dielectric sleeves 130,160 flange 146 of forward sleeve 130 receives forwardly extending flange 174 of rearward sleeve 160 providing overlapping dielectric structure about intermediate contact 110; abutment is generated between stop surface 150 of sleeve 130 with the edge of forward end 164 of sleeve 160, and between stop surface 170 of rearward sleeve 160 with the edge of rearward end 136 of forward sleeve 130. Slight compression of the resilient dielectric material of the sleeves may preferably occur by careful control of lengths and diameters especially at their interface so long as no interference occurs with forward flange 34 of rearward outer contact 30 tightly fitting over rearward end 26 of forward shell 20 which secures the adapter assembly 10 together.

The adapter assembly 10 of the present invention is assembled of components of carefully controlled dimension and shape, and assembled to interlock and thereby self-retain together in such a manner, that assures that inner contact 50 is precisely located coaxially within intermediate contact 110 and outer contact 20,30 and precisely located axially therewithin so that ends 64 and 66 of pin contact sections 60,62 are located at known incremental distances from forward and rearward ends of intermediate contact 110 and outer contact 20,30; and further, that inner contact 50 is secured immobile within intermediate contact 110 which in turn is secured immobile within outer contact 20,30 by means of the series of abutting surfaces of forward and rearward first and second dielectric sleeves respectively. Overlapping structure of the forward and rearward sleeves of the inner and outer sleeve pairs provides assured insulation between the inner, intermediate and outer contacts of the triaxial adapter assembly, in a manner which does not interfere with assembly of the components.

Figure 6:
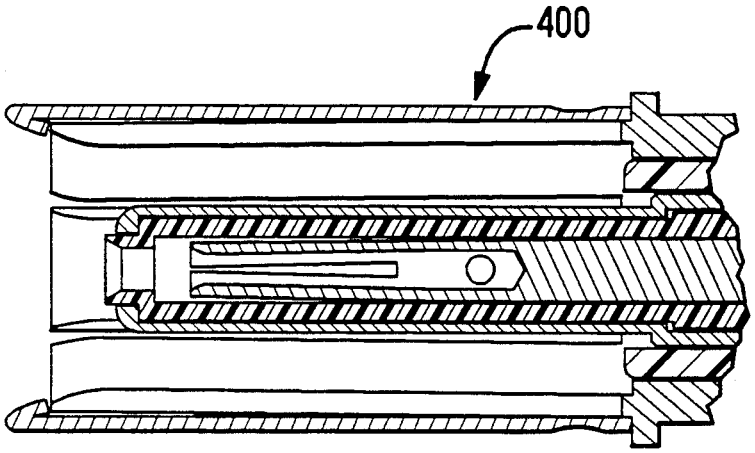
Figure 6 Prior Art
FIG. 6 is a section view of a PRIOR ART triaxial connector.
Figure 7:
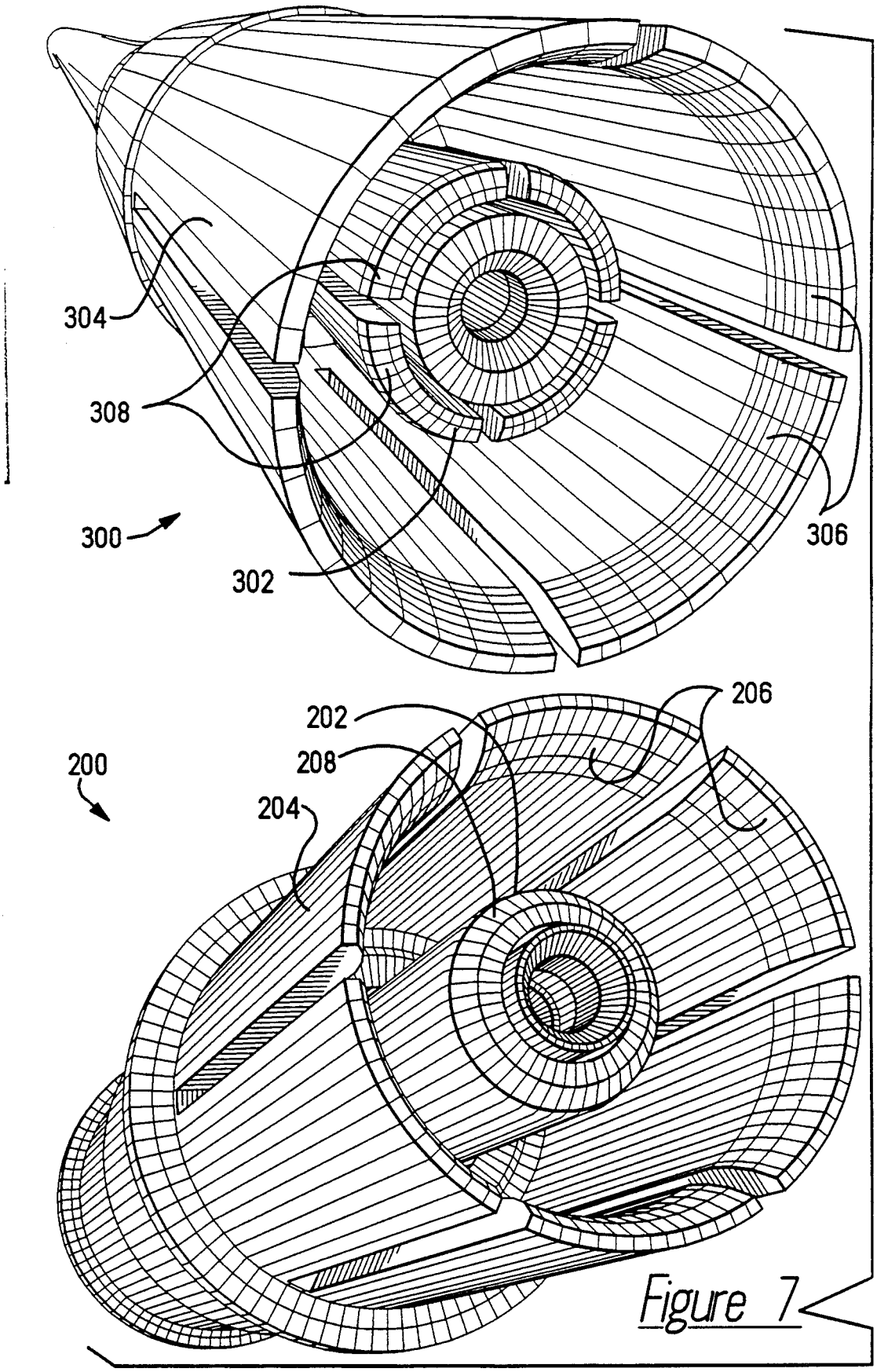
FIG. 7 is an enlarged view in exaggerated perspective of the mating interfaces of the two types of triaxial connectors with which the adapter is matable.

Providing spring arms 128 on intermediate contact 110 enables the overall length of the mating interface of at least one end of adapter assembly 10 to be minimized, since the length of plug portion 202 of triaxial connector 200 can be reduced with minimal impact on performance, as compared with a conventional triaxial connector 400 as shown in FIG. 6. Adapter 10 permits interconnection with the type of connector 300 which is in widespread in-service use. An immediate benefit of such an interconnection is the ability to retrofit a filter-containing adapter assembly (not shown) which may also contain nontriaxial contacts to an array of triaxial connectors 300 secured within connector assemblies (not shown) also containing nontriaxial contacts for signal transmission circuits which connector assemblies are already mounted within structures and apparatus with minimal difficulty in limited space.

Adapter assembly 10 can also be fabricated to provide mating interfaces at both ends which are identical so that two triaxial connectors 200 or two triaxial connectors 300 can be interconnected. Variations and modifications may be made to the components and to the manner of assembly of the present adapter without departing from the spirit of the invention or the scope of the claims.

What is claimed is:

1. An adapter assembly for interconnecting two triaxial connectors of the type having an inner signal contact, an intermediate ground therearound, and an outer conductor therearound, comprising:

an inner contact member disposed within a first dielectric sleeve means and coaxially disposed within an intermediate contact member, all of which is disposed within a second dielectric sleeve means and coaxially within an outer contact means;

said inner contact member including a body section extending between forward and rearward contact sections and an annular collar around said body section cooperable with stop surfaces of said first sleeve means to assure precise locating of first and second contact ends with respect to forward and rearward stop means of said first sleeve means;

said intermediate contact member being tubular and having forward and rearward ends and including at least a first stop means therewithin cooperable with a corresponding one of said forward and rearward stop means of said first sleeve means to assure precise locating of said first sleeve means therewithin, in conjunction with a retention means firmly securable within said intermediate contact member at a selected location therealong and cooperable with the other of said forward and rearward stop means of said first sleeve means;

said intermediate contact member further including an annular collar therearound cooperable with stop surfaces of said second sleeve means to assure precise locating of said first and second contact ends of said inner contact member held within said intermediate contact member, with respect to forward and rearward stop means of said second sleeve means; and said outer contact means being tubular and having forward and rearward ends and being continuous axially along the assembly at least after assembly thereof and including forward and rearward stop means therewithin cooperable with said forward and rearward stop means of said second sleeve means to assure precise locating of said first and second contact ends of said inner contact member held within said intermediate contact member within said outer contact means;

said first sleeve means adapted to provide dielectric material about said inner contact adapted to provide dielectric material about said intermediate contact continuously therealong;

whereby the inner contact member, first sleeve means, intermediate contact member, second sleeve means and outer contact means define a series of interrelated precisely located stop means when assembled to assure precise locating of contact sections of said inner contact with respect to ends of the adapter assembly and indirectly with respect to corresponding contact means of opposing triaxial connectors matable therewith.

2. The adapter assembly as set forth in claim 1 wherein at least one of said contact sections of said inner contact member is a pin section, and said intermediate contact includes a contact section around said pin section, said contact section of said intermediate contact including a plurality of slightly converging spring arms extending axially outwardly therefrom at least at one end, adapted to be engaged and deflected outwardly by an outward surface of an intermediate contact means about a plug portion of a mating triaxial connector received into a corresponding end of the adapter assembly.

3. The adapter assembly as set forth in claim 1 wherein said first sleeve means comprises forward and rearward first sleeve members having rearward and forward ends respectively adapted to define an interface at said annular collar of said inner contact when inserted over forward and rearward ends of said inner contact member, said annular collar having a known outer diameter and one of said rearward and forward ends having an enlarged inside diameter to define a ledge and an axial flange just larger than said annular collar diameter and having a length selected to extend over and past said annular collar abutting said ledge upon assembly, and the other of said rearward and forward ends having a reduced outer diameter just less than said enlarged inside diameter of said axial flange to receive said axial flange thereover when abutting said annular collar, said interface defining said stop means of said first sleeve means cooperable with said annular collar and also continuous dielectric structure about said inner contact body section.

4. The adapter assembly as set forth in claim 3 wherein said forward and rearward sleeve members have outer diameters just less than the inside diameter of said intermediate contact member.

5. The adapter assembly as set forth in claim 1 wherein said stop means within said intermediate contact member comprises an annular ledge therewithin disposed near one of said forward and rearward ends thereof, said annular ledge being cooperable with a corresponding annular stop surface defined proximate a corresponding one of said forward and rearward ends of said first sleeve means, and said retention means comprising a ring member force fittable into the other of said forward and rearward ends of said intermediate contact following placement of said inner contact member and first sleeve means within said intermediate contact until abutting a corresponding annular stop surface defined proximate the other of said forward and rearward ends of said first sleeve means urging said first sleeve means into abutment with said annular ledge, said retention means being selected to be engageable with an inner surface portion of said intermediate contact member with sufficient strength to self-retain therewithin and resist stress upon subsequent handling and mating and unmating of the adapter assembly with corresponding mating triaxial connectors.

6. The adapter assembly as set forth in claim 5 wherein said retention means is an annular ring having an outer diameter just larger than the inner diameter of a corresponding portion of an inside surface of said intermediate contact, and having an inner diameter selected to fit over an adjacent end of said first sleeve means until pressed into abutting engagement with a corresponding stop surface thereof proximate said adjacent end and urge said first sleeve means into abutting engagement with said annular ledge within said intermediate contact whereupon insertion of said annular ring into said intermediate contact is stopped, with said first sleeve means and said inner contact held therewithin being secured within said intermediate contact in known axial location.

7. The adapter assembly as set forth in claim 6 wherein said first sleeve means includes a reduced outer diameter section at said adjacent end to receive said annular ring therearound and defining said corresponding stop surface abutting said annular ring.

8. The adapter assembly as set forth in claim 1 wherein said inner contact and said first sleeve means are securable within said intermediate contact to define a subassembly wherein said contact sections of inner contact are precisely located with respect to forward and rearward ends of said intermediate contact.

9. The adapter assembly as set forth in claim 8 wherein said second sleeve means comprises forward and rearward second sleeve members, and said outer contact means comprises forward and rearward outer contact shell members within which said forward and rearward second sleeve members are disposed, said forward second sleeve member and said forward outer contact shell being insertable over a forward end of said subassembly, said rearward second sleeve member and said rearward outer contact shell being insertable over a rearward end of said subassembly and abuttable upon assembly with an adjacent end of said forward second sleeve member and said forward outer contact shell at an outer interface extending outwardly from said annular collar of said intermediate contact member, said forward and rearward outer contact shell members adapted to telescopically secure to each other about said forward and rearward second sleeve members and said subassembly therewithin to define a continuous outer contact.

10. The adapter assembly as set forth in claim 9 wherein said forward and rearward second sleeve members have rearward and forward ends respectively adapted to define an interface at said annular collar of said intermediate contact when inserted over forward and rearward ends of said subassembly, said intermediate contact annular collar having a known outer diameter and one of said rearward and forward ends having an enlarged inside diameter to define a ledge and an axial flange just larger than said annular collar diameter and having a length selected to extend at least over said annular collar abutting said ledge upon assembly, and one of said rearward and forward ends having an enlarged outer diameter just greater than an outside diameter of the other of said rearward and forward ends to receive said other of said ends therewithin when respective said stop means of said forward and rearward second sleeve members abut said annular collar, said second sleeve interface defining said stop means of said second sleeve means cooperable with said intermediate contact annular collar and also continuous dielectric structure about said intermediate contact.

11. The adapter assembly as set forth in claim 1 wherein at least one of said contact sections of said inner contact member is a pin section, and said intermediate contact includes a contact section around said pin section, said contact section of said intermediate contact about said pin section being barrel-shaped and having an inner diameter adapted to engage and deflect inwardly an array of slightly diverging spring arms of an intermediate contact means about a plug portion of a mating triaxial connector received into a corresponding end of the adapter assembly.

12. The adapter assembly as set forth in claim 11 wherein said inner diameter of said barrel-shaped contact section of said intermediate contact is gradually tapered to a smaller diameter inwardly from the end thereof.

* * * * *

UNITED STATES PATENT AND TRADEMARK OFFICE

CERTIFICATE OF CORRECTION

PATENT NO. : 5,062,808

DATED : November 5, 1991

INVENTOR(S) : Robert C. hosler, Jr.

It is certified that error appears in the above-identified patent and that said Letters Patent is hereby corrected as shown below:

Claim 1, column 7, line 68 - after the word "contact" insert --continuously therealong, and said second sleeve means--.

Signed and Sealed this

Second Day of March, 1993

*Attest:*

STEPHEN G. KUNIN

*Attesting Officer*

*Acting Commissioner of Patents and Trademarks*